United States Patent [19]

Olivier et al.

[11] Patent Number: 4,576,551

[45] Date of Patent: Mar. 18, 1986

[54] TURBO MACHINE BLADING

[75] Inventors: Paul D. Olivier, Scottsdale, Ariz.; Lester E. Chadbourne, deceased, late of Scottsdale, Ariz., by Mary T. Chadbourne, personal representative

[73] Assignee: The Garrett Corporation, Los Angeles, Calif.

[21] Appl. No.: 389,519

[22] Filed: Jun. 17, 1982

[51] Int. Cl.[4] ..... F01D 5/22

[52] U.S. Cl. ..... 416/191; 416/196 R; 415/172 A; 29/156.8 B

[58] Field of Search ..... 416/190, 191, 192, 500, 416/195, 212 A, 196 R; 415/172 A; 51/217 R; 29/156.8 R, 156.8 B

[56] References Cited

U.S. PATENT DOCUMENTS

| | | | |
|---|---|---|---|
| 940,874 | 11/1909 | Hedlund | 416/219 |
| 1,304,793 | 5/1919 | Moore | 416/212 A X |
| 1,371,328 | 3/1921 | Schneider | 416/191 |
| 1,639,247 | 8/1927 | Zoelly et al. | 416/190 |
| 2,510,734 | 6/1950 | Bodger | 416/190 |
| 2,681,500 | 6/1954 | Whitehead | 29/156.8 |
| 2,971,743 | 2/1961 | Welsh . | |
| 3,104,093 | 9/1963 | Craig et al. | 416/190 X |
| 3,182,441 | 5/1965 | Reuter . | |
| 3,328,867 | 7/1967 | Guengant | 29/156.8 |
| 3,331,166 | 7/1967 | Brenning | 51/217 R |
| 3,335,483 | 8/1967 | Howald | 29/156.8 |
| 3,377,050 | 4/1968 | Guy | 416/191 |
| 3,479,009 | 11/1969 | Bean | 416/191 X |
| 3,527,544 | 9/1970 | Allen | 416/191 X |
| 3,600,781 | 8/1971 | Scott | 29/156.8 B |
| 3,606,578 | 9/1971 | Ortolano | 416/191 |
| 3,981,615 | 9/1976 | Krol | 416/190 |
| 3,986,792 | 10/1976 | Warner | 416/190 |
| 4,028,788 | 6/1977 | DeMusis | 29/156.8 B |
| 4,076,455 | 2/1978 | Stargardter | 416/191 |
| 4,128,929 | 12/1978 | DeMusis | 29/156.8 B |
| 4,400,915 | 8/1983 | Arrigoni | 51/217 R |

FOREIGN PATENT DOCUMENTS

| | | | |
|---|---|---|---|
| 485833 | 11/1929 | Fed. Rep. of Germany | 416/192 |
| 606351 | 11/1934 | Fed. Rep. of Germany | 416/212 A |
| 1340331 | 9/1963 | France | 416/191 |
| 39807 | 3/1977 | Japan | 416/191 |
| 128868 | 10/1959 | U.S.S.R. | 416/191 |
| 641128 | 1/1979 | U.S.S.R. | 416/191 |

*Primary Examiner*—Everette A. Powell, Jr.
*Attorney, Agent, or Firm*—Terry L. Miller; Albert J. Miller

[57] ABSTRACT

Blading for a turbo machine which facilitates manufacturing thereof.

15 Claims, 3 Drawing Figures

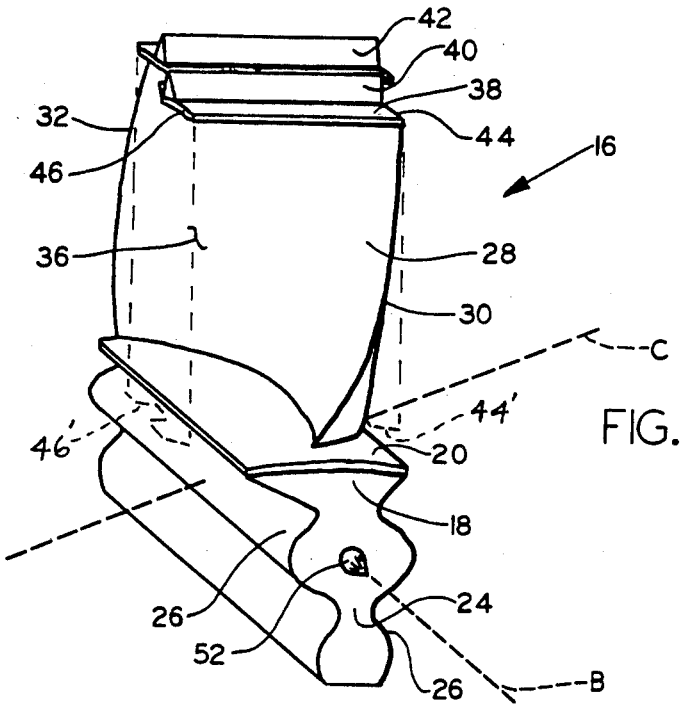
FIG. 2
FIG. 3
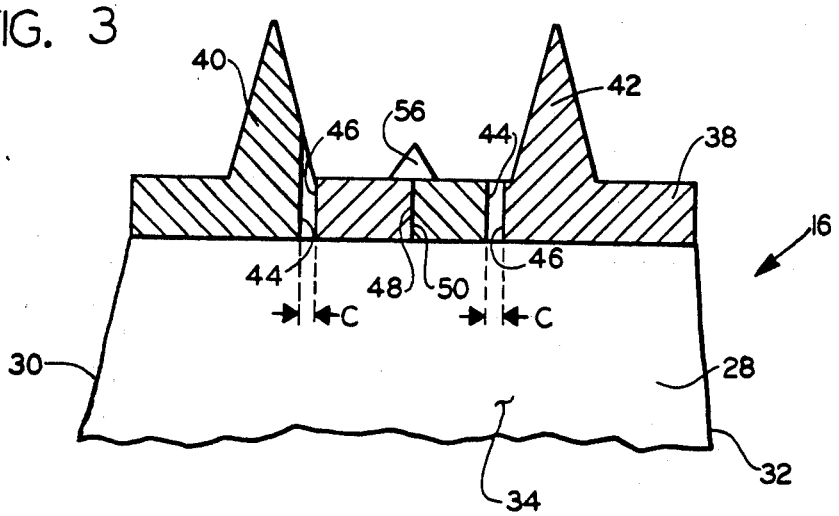

TURBO MACHINE BLADING

BACKGROUND OF THE INVENTION

The field of this invention is turbo machine blading and methods. More particularly, this invention relates to fluid energy reactive blading for a rotatable blade wheel of a combustion turbine engine.

The most pertinent conventional turbo machine blading known to the applicant is illustrated in U.S. Pat. Nos. 2,971,743; 3,185,441; and 3,479,009. Because the last of these patents is perhaps the most relevant to this invention, a brief discussion of the blading illustrated by this patent follows in order to afford the reader with an understanding of a few of the deficiencies of conventional turbo machine blading.

Upon examination of the turbo machine blading illustrated in U.S. Pat. No. 3,479,009, it will be noted that each of the blades includes a circumferentially extending shroud section which is generally S-shaped to define axially and radially extending curvilinear abutment surfaces. The abutment surfaces of each shroud section interlock with the matching abutment surfaces of next adjacent blades so that a substantially continuous shroud is defined by the interlocking shroud sections. Because the curvilinear abutment surfaces of the shroud sections extend axially, a radial projection of these shroud surfaces toward the axis of blade wheel rotation intersects with the platform or base of the respective blades. Consequently, when these abutment surfaces are formed during manufacture of a blade, the forming tool must be advanced to form the abutment surfaces and then be retracted before the tool engages and damages the blade platform. For example, if the curvilinear abutment surfaces are formed by the use of a grinding wheel dressed to a matching shape, the grinding wheel must be passed radially inwardly relative to the shroud section to generate the abutment surfaces thereon, be stopped, and then be retracted radially outwardly. Such an advance-stop-retract type of machining operation is time consuming and costly. Thus, because turbo machines usually contain many blades, the cost of machining the blading can be a significant portion of the total manufacturing cost for the turbo machine. Further, such a machining operation has the potential for damaging a blade if the machining tool is advanced too far and cuts into the blade platform.

A further aspect of manufacturing conventional turbo machinery blading involves obtaining a reference position of a blade preparatory to performing machining operations on the blade. Conventionally, a fixture is used which supports the blade, at least in part, by engaging the airfoil or bucket portion of the blade. The blade may additionally be supported by the fixture engaging another portion of the blade. For example, the fixture may also engage the platform portion of the blade. In any case, fixturing which engages the airfoil or bucket portion of a blade is necessarily complex and expensive because of the complex nature of the airfoil or bucket surface which the fixture must engage. Additionally, this type of fixture may damage the airfoil or bucket portion of a blade so that the blade must be scrapped.

SUMMARY OF THE INVENTION

This invention provides turbo machinery blading and methods which by their nature greatly facilitate simplified and low-cost serial manufacturing of the blading.

Specifically, the shroud section of each blade on a blade wheel defines end surfaces which confront complementary end surfaces of adjacent blades. The end surfaces define abutment surfaces engageable with like abutment surfaces on adjacent blades; and which cooperate to define a radially extending transverse plane relative to the rotational axis of the blade wheel. Consequently, a projection of the end surfaces radially inwardly does not intersect the platform of the blade. As a result, during manufacturing of a blade according to the invention, a forming tool for forming the end surfaces of the shroud section may be moved in a single direction relative to the blade. For example, if a shape-dressed grinding wheel is to be used to form the abutment surfaces, a pair of such wheels rotating in a common plane and separated by an appropriate distance may be used. By passing a blade between the grinding wheels in a single direction in the plane of the grinding wheels, the pair of grinding wheels will form the abutment surfaces precisely and quickly; and at a very low cost.

According to a specifically described preferred embodiment of the invention, a turbine blade for a combustion turbine engine includes three cooperating physical features at novel predetermined locations on the blade. The three physical features cooperate to define a reference plane coextensive with the blade. The three physical features are positioned on the blade so as to cooperate with a fixture in a novel way to hold the blade for machining of the shroud section end surfaces and of other surfaces of the blade. Because the three physical features are located on the blade in novel locations, a single fixture may be used to hold the blade during all required machining operations. Consequently, manufacturing costs are reduced by the invention while the expense of multiple fixtures is eliminated. Further, complex fixturing of the type which engages the airfoil portion of the blade is rendered unnecessary by the invention.

In the light of the above, it is easily appreciated that this invention provides turbo machine blading and methods which significantly reduce the manufacturing costs of such turbo machines. Consequently, the invention may make the advantages of turbo machines, such as combustion turbine engines, available to the public at a lower cost than has heretofore been possible.

BRIEF DESCRIPTION OF THE DRAWINGS

FIG. 2, depicts an isolated perspective view of one of the blades carried by the blade wheel illustrated by FIG. 1; and FIG. 3 is an enlarged fragmentary cross sectional view taken along line 3—3 of FIG. 1.

DETAILED DESCRIPTION OF THE PREFERRED EMBODIMENT

Figure 1:
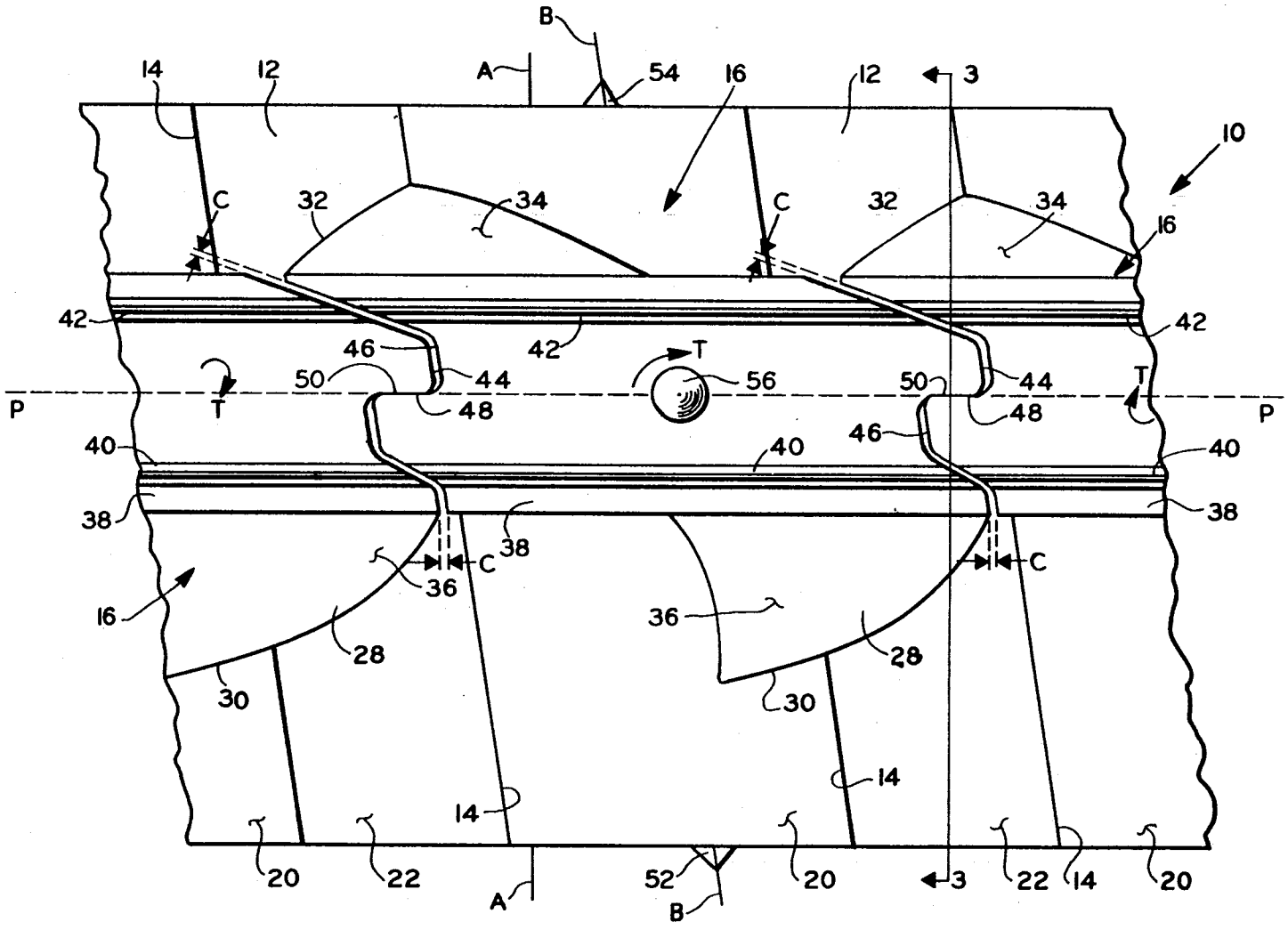
FIG. 1 depicts a fragmentary view of a blade wheel of a combustion turbine engine; viewed radially inwardly toward the rotational axis of the blade wheel.

FIG. 1 illustrates a preferred embodiment of the invention wherein a combustion turbine engine 10 includes a blade wheel 12 (only a rim portion of which is visible in FIG. 1). The blade wheel 12 is rotational about an axis (represented by lines A—A) and defines a multitude of axially and circumferentially extending slots 14 which receive a multitude of circumferentially adjacent blades 16 extending radially outwardly on the blade wheel 14 (only one complete blade 16 being visible in FIG. 1).

Viewing FIGS. 1 and 2 it will be seen that each blade 16 includes a platform section 18. When the blade 16 is received in a slot 14 of the blade wheel 12, a radially outer arcuate surface 20 of the platform section aligns with a peripheral surface 22 of the blade wheel. The platform section 18 includes a radially inwardly and axially extending root section 24 of the "fir tree" type. A number of axially extending surfaces 26 are defined by the root section 24 for interlocking engagement with the blade wheel 12 at a slot 14. A generally airfoil-shaped portion 28 extends radially outwardly span-wise from the platform section 18. The airfoil portion 28 is span-wise twisted and defines a leading edge 30, a trailing edge 32, and convex and concave surfaces 34 and 36, respectively, extending between the leading and trailing edges.

Of course, it will be understood that the portion 28 of blade 16 may be airfoil-shaped, as illustrated, to operate according to reaction principles or may be shaped to operate according to impulse principles. Alternatively, the portion 28 may be shaped to operate according to a combination of both reaction and impulse principles. Regardless of the shape of the portion 28, it is designed to operate in energy-transfer relation with a fluid in the engine 10 so that the blade portion 28 is fluid energy reactive.

Each blade 16 includes a circumferentially extending integral tip shroud segment 38. Viewing FIG. 1, it will be seen that the tip shroud segments of circumferentially adjacent blades 16 cooperate to define a substantially continuous annular tip shroud which is spaced radially outwardly of the blade wheel periphery 22. A pair of circumferentially extending and axially spaced apart integral knife-edge elements 40 and 42 are carried by the shroud segments 38. The knife-edge elements 40 and 42 extend radially outwardly to sealingly cooperate with other structure (not shown) of the turbine engine 10 so as to prevent fluid leakage radially outwardly of the shroud segments 38.

Each shroud segment 38 defines oppositely circumferentially disposed end surfaces 44 and 46 which are somewhat similarly S-shaped (albeit, a backwards 'S' viewing FIG. 1). The end surfaces 44 and 46 extend axially and radially to confront one another and define a clearance 'C' therebetween, viewing FIGS. 1 and 3. However, portions 48 and 50 of the end surfaces 44 and 46, respectively, extend circumferentially to define an abutment surface engageable with the corresponding surface of the next adjacent blade. The abutment surfaces 48 and 50 cooperate to define a radially extending transverse plane (as represented by line P—P, viewing FIG. 1) relative to the rotational axis A—A.

Viewing the figures, it will be noted that each of the platform sections 18 defines a pair of oppositely disposed cone-shaped protrusions 52 and 54 extending substantially axially therefrom. Further, the tip shroud segment 38 defines a radially extending cone-shaped protrusion 56 between the knife-edge elements 40 and 42. The protrusions 52–56 cooperate to define a reference plane coextensive with the blade 16.

During operation of the turbine engine 10, the blade wheel 12 rotates at a high rate of speed. Consequently, the blades 16 are subjected to a strong centrifugal force. As a result of the centrifugal force, the air foil portion 28 of each blade attempts to untwist, imposing a clockwise torque on each of the shroud segments 38 (represented by arrows 'T', viewing FIG. 1). Because of the torques T on the shroud segments 38, the abutment surfaces 48 and 50 of circumferentially adjacent shroud segments are biased into engagement. In this way, the torque on each shroud segment 38 is counterbalanced by the torque of the adjacent shroud segments. Additionally, the engaging surfaces 48 and 50 act to frictionally damp any blade vibrations in a circumferential direction.

Having observed the structure and operation of the engine 10, attention may now be directed to the way in which the structure of the blades 16 results in many manufacturing simplifications and economies. The blades 16 are made from inventment castings which require machining to form the surfaces 26 on the root section 24 and to form the surfaces 44–50 on the shroud segment 38. Accordingly, viewing FIG. 2 a fixture (not shown) may be employed to engage the protrusions 52–56 of the blade 16 so that the blade is restrained from movement in all directions relative to the fixture. In order to form the surfaces 26, the fixture with blade 16 therein is passed between a first pair of coplanar shape-dressed grinding wheels in a first direction along a fixed reference line B, which may be visualized as fixed in space. The reference line B is coincident with the protrusions 52 and 54, as the blade is oriented viewing FIG. 2. The first pair of grinding wheels lie in a plane defined by the cooperation of the line B and a mutually perpendicular line C, which may be visualized as having a fixed orientation in space while being movable along line B. Thus, the line C is substantially perpendicular to the reference plane defined by protrusions 52–56, recalling that protrusions 52, 54 are coincident with line B. When the blade 16 is passed between the first pair of grinding wheels they engage the blade to form the surfaces 26. Subsequently, the fixture and blade 16 continue in the first direction along the line B while being rotated approximately 90 degrees in the reference plane defined by protrusions 52–56 about the line C, which is substantially perpendicular to the reference plane, viewing FIG. 2. As a result, the shroud segment 38 is brought into the plane of lines B-C. The blade of FIG. 2 will thus be tipped substantially 90° toward the viewer about line C. Thereafter, the fixture and blade 16 is passed in the first direction along line B between a second pair of shape-dressed grinding wheels which form the surfaces 44 and 46.

Accordingly, it will be understood that the surfaces 44, 46 are generated individually by mutually parallel straight line segments which extend substantially radially, as is best depicted viewing FIG. 3

Observing FIG. 1, it will be seen that a projection of the surfaces 44 and 46 toward the platform 18 does not intersect the platform 18. More particularly, FIG. 2 illustrates that radially inward projections of the surfaces 44, 46 parallel to the radially extending straight line segments which define these surfaces do not intersect with the platform 18. Viewing FIG. 2, the intersections of the radially projected surfaces 44, 46 with a transverse plane at the widest circumferential extension of platform 18 are depicted by phantom lines 44' and 46', respectively. The lines 44', 46' are spaces circumferentially away from and do not intersect the platform 18. Therefore, the fixture and blade 16 may continue in the first direction along line B with the second pair of grinding wheels passing clear of the platform 18. Thus, it is easily perceived that all of the machined surfaces on the blade 16 may be formed during a substantially continuous motion of the blade in a first direction along the line B. Further, it will be understood that the only portions of the surfaces 44 and 46 which are truely radial when the blade 18 is installed upon the blade wheel 12 are the abutable portions 48 and 50. That is, all of the confronting surfaces 44,46, save abutting portions 48,50 of adjacent tip shroud segments 38 are nonparallel when the blades 16 are installed upon blade wheel 12. However, such nonparallelism of surfaces 44,46 is of no detrimental effect because these nonparallel surfaces are spaced apart by clearances C. The abutting surface portions 48, 50 are truly parallel and are engageable to define an area contact for frictional vibration damping and torque resistive interaction between adjacent blades 16. Such is the case, of course, because the surfaces 48, 50 lie on the transverse radial plane P—P, viewing FIG. 1. As pointed out supra, the abutable portions 48 and 50 cooperate to define a transverse radial plane relative to the rotational axis of blade wheel 12.

In light of the above, it is apparent that this invention relates to both turbo machinery blading structure and methods. While this invention has been described with reference to a specific preferred embodiment thereof, no limitation upon the invention should be implied because of such reference. The invention is intended to be limited only by the scope and spirit of the appended claims which alone define the invention.

We claim:

1. On a turbo machine blade wheel, a multitude of circumferentially disposed fluid energy reactive blade members engaging one another only at abutment surfaces defined thereon which lie in a transverse radial plane relative to the rotational axis of said blade wheel.

2. The invention of claim 1 wherein each one of said multitude of blade members includes a shroud segment and a platform section disposed radially inwardly of said shroud segment, said shroud segment defining a pair of oppositely disposed circumferential end surfaces, a projection of at least one of said pair of end surfaces being nonintersecting with said platform section.

3. In a turbo machine, the method of restraining a circumferentially disposed multitude of normally twisted and radially outwardly extending blade members on a rotatable blade wheel from untwisting in response to centrifugal force, said method comprising the steps of:

forming circumferentially extending shroud segments on each one of said multitude of blade members;

forming circumferentially extending complementary abutment surfaces on each one of said shroud segments, each of said complementary abutment surfaces cooperating to define a transverse radial plane relative to the rotational axis of said blade wheel; and engaging said blade members with one another only at said complementary abutment surfaces of adjacent blade members.

4. A blade member for use in a turbo machine, said turbo machine having a plurality of substantially identical circumferentially adjacent blade members carried at the perimeter of a rotatable blade wheel and extending radially outwardly thereon with respect to the axis of blade wheel rotation, said blade member comprising:

a platform portion adjacent said blade wheel and including means for intersecuring said blade member with said blade wheel;

reaction portion means for fluid energy reaction with a working fluid of said turbo machine, said reaction portion means extending substantially radially outwardly from said platform portion with respect to said rotation axis;

axially and circumferentially extending shroud segment means integrally formed with said reaction portion means at a radially outer termination thereof for cooperating with similar shroud segments of circumferentially adjacent blade members upon said blade wheel perimeter both to define a substantially continuous circumferential shroud upon said blade wheel and to resist twisting moments imposed upon said blade member about a radially extending axis by centrifugal force during operation of said turbo machine, said shroud segment means defining a circumferentially oppositely disposed pair of end surfaces which extend axially radially and circumferentially to confront similar complementary end surfaces upon next adjacent shroud segments, an extension of each one of said pair of end surfaces generally radially inwardly toward said rotational axis being nonintersecting with said platform portion, each one of said pair of end surfaces defining an abutment surface portion for abutment with a matching surface on a next adjacent shroud segment while remaining everywhere else spaced apart from said complementary end surface thereof to define a clearance therewith, said abutment surface portions lying on a transverse radial plane with respect to said rotational axis.

5. The invention of claim 4 wherein said blade member further defines means singularly for cooperating with a fixture device during manufacture of said blade member to define a reference plane coextensive therewith.

6. The invention of claim 5 wherein said means for defining a reference plane coextensive with said blade member includes at least three features on said blade member having a singular function of cooperation with said fixture device.

7. The invention of claim 6 wherein each one of said three features comprises a generally cone-shaped protrusion integrally defined by said blade member.

8. The invention of claim 4 wherein said pair of end surfaces are mutually parallel with respect to an extension thereof radially inwardly toward said axis of rotation.

9. In a turbo machine having a blade wheel rotatable about an axis, a multitude of fluid energy reactive blades secured at the perimeter of said blade wheel, each one of said multitude of blades including a circumferentially extending shroud segment, said shroud segments cooperating to define a circumferentially extending shroud, one of said shroud segments defining a pair of circumferentially extending abutment surfaces engaging matching abutment surfaces on adjacent shroud segments and being everywhere else spaced from said adjacent shroud segments to define a clearance therewith, said abutment surfaces cooperating to define a transverse radial plane relative to said axis, said one shroud segment being carried by one of said blades which includes a platform section adjacent said blade wheel perimeter, said shroud segment defining a pair of oppositely disposed circumferential end surfaces which extend axially and radially, each one of said pair of circumferential end surfaces including a circumferentially extending portion defining one of said pair of abutment surfaces, and a projection of said circumferential end surfaces parallel therewith and substantially radially inwardly toward said platform section being nonintersecting with said platform section.

10. The invention of claim 9 wherein said blade further includes means singularly for mountingly cooperating with a holding device to substantially preventing relative movement therebetween.

11. The invention of claim 10 where said mounting means comprises said shroud segment defining a conical protrusion extending substantially radially outwardly thereon.

12. The invention of claim 10 wherein said mounting means comprises said platform portion defining a pair of substantially oppositely axially extending conical protrusions thereon.

13. The invention of claim 12 wherein said platform section defines means for removably securing said blade to said blade wheel, said securing means comprising surfaces extending substantially axially and substantially parallel to a line defined by said pair of conical protrusions on said platform section.

14. Blading on a blade wheel of a turbo machine, a shroud segment of each blade defining abutment surfaces cooperating with like abutment surfaces on next adjacent blades, said abutment surfaces cooperating to define and lying in a transverse radial plane relative to the rotational axis of said blade wheel, each of said blades including a platform section adjacent said blade wheel, each of said blades further including a circumferentially spaced apart pair of said abutment surfaces, projections of said pair of abutment surfaces which are parallel to a radial line passing therebetween being nonintersecting with said platform section of the respective blade, wherein adjacent shroud segments of each blade upon said blade wheel are everywhere spaced apart to define a clearance space therebetween save at said cooperating abutment surfaces which are intimately engageable one with the other.

15. In a turbo machine, a blade wheel rotatable about an axis and defining an outer perimeter, a multitude of radially extending and circumferentially spaced fluid energy reactive blades secured to said blade wheel at said outer perimeter, each one of said multitude of blades including a circumferentially extending tip shroud segment, said tip shroud segments cooperating to define a circumferentially extending tip shroud which is substantially continuous circumferentially, each one of said tip shroud segments defining a circumferentially and radially extending abutment surface engaging a matching abutment surface on the next adjacent blade, said abutment surfaces defining a transverse radial plane relative to said axis, each one of said multitude of blades including a platform section, a projection of each one of said abutment surfaces toward the respective platform section of each blade being nonintersecting with said platform section, wherein adjacent ones of said tip shroud segments are everywhere spaced apart to define a clearance therebetween with the exception of said abutment surfaces which are intimately engageable with each other.

* * * * *